US007551046B2

(12) United States Patent
Mei

(10) Patent No.: US 7,551,046 B2
(45) Date of Patent: Jun. 23, 2009

(54) BAND PASS FILTER

(75) Inventor: Chia-Hao Mei, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 89 days.

(21) Appl. No.: 11/615,943

(22) Filed: Dec. 23, 2006

(65) Prior Publication Data

US 2008/0030287 A1 Feb. 7, 2008

(30) Foreign Application Priority Data

Aug. 4, 2006 (TW) ..... 95128626 A

(51) Int. Cl.
*H01P 1/203* (2006.01)

(52) U.S. Cl. ..... 333/204; 333/219

(58) Field of Classification Search ..... 333/204
See application file for complete search history.

(56) References Cited

U.S. PATENT DOCUMENTS

| | | | | |
|---|---|---|---|---|
| 4,475,092 | A | 10/1984 | Epsom et al. | |
| 5,684,440 | A * | 11/1997 | Yabuki et al. | 333/204 |
| 6,608,537 | B2 * | 8/2003 | Kanba et al. | 333/204 |
| 6,630,875 | B2 * | 10/2003 | Mizoguchi et al. | 333/204 |
| 6,686,816 | B1 * | 2/2004 | Schallner | 333/204 |
| 6,977,564 | B2 * | 12/2005 | Kanba et al. | 333/204 |

* cited by examiner

*Primary Examiner*—Benny Lee
*Assistant Examiner*—Alan Wong
(74) *Attorney, Agent, or Firm*—Wei Te Chung

(57) ABSTRACT

A band pass filter (10) mounted on a base plate (20) includes a loop-step resonator (12), an input portion (100), and an output portion (150). The input portion is electronically connected to the loop-step resonator for inputting electromagnetic signals thereto. The output portion is electronically connected to the loop-step resonator for outputting electromagnetic signals therefrom.

13 Claims, 2 Drawing Sheets

BAND PASS FILTER

BACKGROUND

1. Field of the Invention

The present invention generally relates to a filter, and more particularly to a band pass filter.

2. Related Art

A filter is able to eliminate interference signals in a communication product. Features of an ideal filter are that signal attenuation is zero within a pass band and becomes infinite within a cut-off band, and a fluctuation from the pass band to the cut-off band should be as sharp as possible. Nowadays, people produce a filter by placing different resonators in different forms. Filters made of step resonators are called low band pass filters. When the low band pass filter is used in a wireless fidelity (WIFI) phone of 2.45 GHz, the low band pass filter cannot effectively eliminate noise caused by nearby global system for mobile communication (GSM) mobile phones working at 1.9 GHz.

Therefore, a heretofore unaddressed need exists in the industry to overcome the aforementioned deficiencies and inadequacies.

SUMMARY

A band pass filter mounted on a base plate includes a loop-step resonator, an input portion, and an output portion. The input portion is electronically connected to the loop-step resonator for inputting electromagnetic signals thereto. The output portion is electronically connected to the loop-step resonator for outputting electromagnetic signals therefrom.

In another embodiment, a band pass filter mounted on a base plate includes an input portion, an output portion, and a loop-step resonator. The loop-step resonator electronically connected to the input portion and the output portion includes a first resonator portion, a second resonator portion, a first connecting portion, and a second connecting portion. The first resonator portion and the second resonator portion are electronically connected by the first connecting portion and the second connecting portion.

Other objectives, advantages and novel features of the present invention will be drawn from the following detailed description of preferred embodiments of the present invention with the attached drawings, in which:

DETAILED DESCRIPTION OF THE EMBODIMENTS

Figure 1:
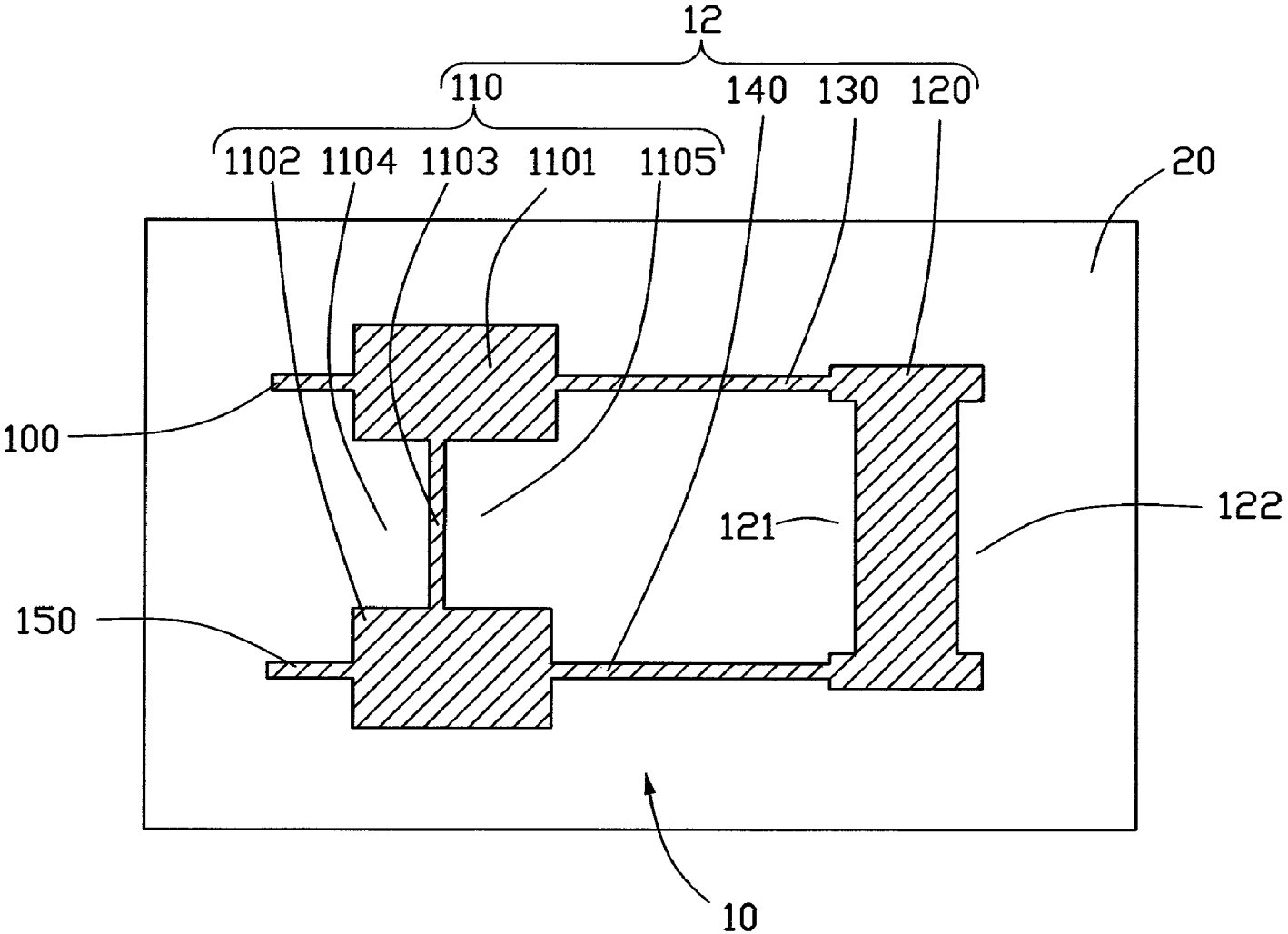
FIG. 1 is a schematic diagram of a band pass filter in accordance with an exemplary embodiment of the invention.

FIG. 1 is a schematic diagram of a band pass filter 10 in accordance with an exemplary embodiment of the present invention.

In this embodiment, the band pass filter 10, mounted on a base plate 20, includes a loop-step resonator 12, an input portion 100, and an output portion 150.

The loop-step resonator 12 eliminates noise in a cut-off band. The input portion 100 is electronically connected to the loop-step resonator 12 for inputting electromagnetic signals thereto. The output portion 150 is disposed parallel to the input portion 100, and is electronically connected to the loop-step resonator 12 for outputting electromagnetic signals therefrom. The input portion 100 and the output portion 150 are disposed at one side of the loop-step resonator 12, and are matching impedances of 50 Ohm.

The loop-step resonator 12 includes a first resonator portion 110, a second resonator portion 120, a first connecting portion 130, and a second connecting portion 140.

In this embodiment, the first resonator portion 110 includes a first resonator block 1101, a second resonator block 1102, a third connecting portion 1103, a first recess 1104, and a second recess 1105. The first resonator block 1101 is electronically connected to the input portion 100. The second resonator block 1102 is electronically connected to the output portion 150. The second resonator portion 120 is disposed parallel to the first resonator portion 110. One end of the first connecting portion 130 is electronically connected to the first resonator block 1101, and the other end of the first connecting portion is electronically connected to the second resonator portion 120. The second connecting portion 140 is disposed parallel to the first connecting portion 130. One end of the second connecting portion 140 is electronically connected to the second resonator block 1102, and the other end of the second connecting portion 140 is electronically connected to the second resonator portion 120. A length and a width of the first connecting portion 130 are the same as those of the second connecting portion 140, and the length and the width of the first connecting portion 130 are 8 millimeter (mm) and 0.5 mm, respectively.

The first resonator portion 110, the first connecting portion 130, the second resonator portion 120, and the second connecting portion 140 are sequentially connected to each other, to cooperatively define a closed-loop shape. A total length of the band pass filter 10 is 20 mm, a total width thereof is 12 mm, and a total area thereof is 240 square mm.

The first recess 1104 and the second recess 1105 are formed between two ends of the first resonator portion 110; that is, the first recess 1104 and the second recess 1105 are formed between first resonator block 1101 and the second resonator block 1102 of the first resonator 110. In this embodiment, the first resonator portion 110 is I-shaped. A length and a width of the first recess 1104 are 5 mm and 2.25 mm, respectively. A length and a width of the second recess 1105 are 5 mm and 3.25 mm, respectively.

The second resonator portion 120 is disposed parallel to the first resonator portion 110. The third recess 121 and the fourth recess 122 are formed between two ends of the second resonator portion 120. In this embodiment, the second resonator portion 120 is I-shaped. A length and a width of the third recess 121 are the same as those of the fourth recess 122. The length and the width of the third recess 121 are 7.5 mm and 0.75 mm, respectively.

In this embodiment, the second recess 1105 is exposed to the third recess 121, and are disposed inside of the loop-step resonator 12. The first recess 1104 and the fourth recess 122 are disposed outside of the loop-step resonator 12.

Figure 2:
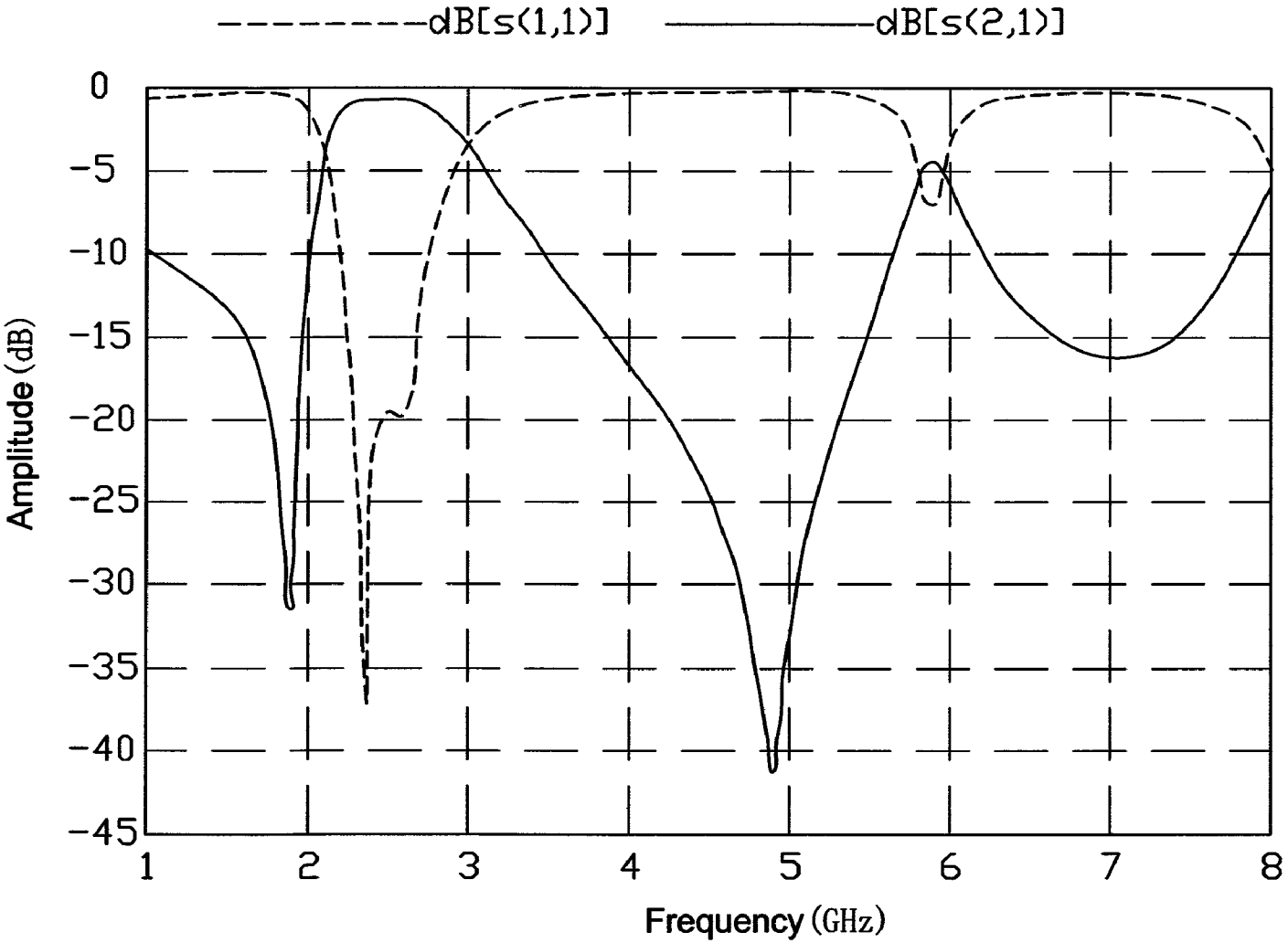
FIG. 2 is a graph showing a relationship between an amplitude of insertion/return loss and a frequency of electromagnetic signals traveling through the band pass filter.

FIG. 2 is a graph showing a relationship between an amplitude of insertion/return loss and a frequency of electromagnetic signals traveling through the band pass filter 10.

As shown in FIG. 2, a horizontal axis represents the frequency (in GHz) of the electromagnetic signals traveling through the band pass filter 10, and a vertical axis represents the amplitude of insertion/return loss (in dB) of the band pass filter 10. The insertion loss of the electromagnetic signals traveling through the band pass filter 10 is indicated by a curve labeled dB[S(2,1)] representing a relationship between an input power and an output power of the electromagnetic signals traveling through the band pass filter 10, and the insertion loss is represented by the following equation:

Insertion Loss=10 *Log [(Output Power)/(Input Power)]

When the electromagnetic signals travels through the band pass filter 10, a part of the input power is returned to a source of the electromagnetic signals. The part of the input power returned to the source of the electromagnetic signals is called a return power. The return loss of the electromagnetic signals traveling through the band pass filter 10 is indicated by the dashed curve labeled dB[S(1,1)], representing a relationship between input power and return power of the electromagnetic signals traveling through the band pass filter 10, and the return loss is represented by the following equation:

Return Loss=10 *Log [(Return Power)/(Input Power)]

For a filter, when an output power of electromagnetic signals in a band pass frequency range is almost equal to an input power thereof, and a return power of the electromagnetic signals is small, it means that a distortion of the electromagnetic signals is small and a performance of the band pass filter 10 is good. As shown in FIG. 2, the band pass filter 10 has a good performance as a band pass filter. The absolute amplitude value of the return loss in the band pass frequency range is greater than a value of 10.

In this embodiment, the first resonator portion 110, the first connecting portion 130, the second resonator portion 120, and the second connecting portion 140 are sequentially connected to each other, to cooperatively define the loop-step resonator 12, and as a result, the band pass filter 10 can operate at a central frequency of 2.4 GHz, and can eliminate noise caused by 1.9 GHz signals in an area near a device utilizing the present invention. The input portion 100 and the output portion 150 have matching impedances of 50 Ohm, so the band pass filter 10 does not require an additional converter, thereby reducing the area of the band pass filter 10.

The band pass filter 10 is able to operate at a central frequency other than 2.4 GHz. One having ordinary skills in the art may change a central frequency by slightly modifying dimensions of the first resonator portion 110, the second resonator portion 120, the first connecting portion 130, and the second connecting portion 140.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A band pass filter mounted on a base plate, comprising:

a loop-step resonator comprising a first resonator portion and a second resonator portion disposed parallel to the first resonator portion;

an input portion electrically connected to the first resonator portion for inputting electromagnetic signals thereto; and an output portion electrically connected to the first resonator portion for outputting electromagnetic signals therefrom;

wherein the first resonator portion comprises a first recess and a second recess formed between two ends thereof, and the second resonator portion comprises a third recess and a fourth recess formed between two ends thereof.

2. The band pass filter as recited in claim 1, wherein the loop-step resonator comprises a first connecting portion electronically connected to the first resonator portion and the second resonator portion, and a second connecting portion electronically connected to the first resonator portion and the second resonator portion.

3. The band pass filter as recited in claim 2, wherein the first resonator portion, the first connecting portion, the second resonator portion, and the second connecting portion are sequentially connected to each other, to cooperatively define a closed-loop shape.

4. The band pass filter as recited in claim 1, wherein the second recess is exposed to the third recess, and the second and third recesses are disposed inside of the loop-step resonator.

5. The band pass filter as recited in claim 4, wherein the first recess and the fourth recess are disposed outside of the loop-step resonator.

6. The band pass filter as recited in claim 1, wherein the input portion and the output portion are matching impedances of 50 Ohm.

7. The band pass filter as recited in claim 1, wherein the input portion and the output portion are disposed at one side of the loop-step resonator.

8. A band pass filter mounted on a base plate, comprising:

an input portion;

an output portion; and a loop-step resonator electrically connected to the input portion and the output portion, comprising a first resonator portion, a second resonator portion, a first connecting portion and a second connecting portion; wherein the first resonator portion and the second resonator portion are electrically connected by the first connecting portion and the second connecting portion, wherein the first resonator portion comprises a first resonator block electrically connected to the input portion, and a second resonator block electrically connected to the cutout portion.

9. The band pass filter as recited in claim 8, wherein the first resonator comprises a third connecting portion electrically connected to the first resonator block and the second resonator block.

10. The band pass filter as recited in claim 8, wherein the first resonator portion and the second resonator portion are connected to each other by the first connecting portion and the second connecting portion, to cooperatively define a closed-loop shape.

11. The band pass filter as recited in claim 8, wherein the first resonator portion comprises a first recess and a second recess formed between the first and second resonator blocks.

12. The band pass filter as recited in claim 11, wherein the second resonator portion comprises a third recess and a fourth recess formed between two ends thereof.

13. A filter assembly comprising:

a base plate; and a filter disposed on said base plate, and comprising an input portion for inputting electromagnetic signals to said filter and an output portion for outputting said electromagnetic signals from said filter, said filter further comprising a resonator electrically connectable with said input portion and said output portion, respectively, for treating said electromagnetic signals in said filter, said resonator comprising a first resonator portion, and a second resonator portion separately spacing from said first resonator portion, at least two connecting portions electrically connectable between said first and second resonator portions, respectively, so as to form said resonator as loop-shaped, wherein said first resonator portion comprises a first recess and a second recess formed between two ends thereof, and said second resonator portion comprises a third recess and a forth recess formed between two ends thereof.

* * * * *